US007410514B2

(12) United States Patent
Binions

(10) Patent No.: US 7,410,514 B2
(45) Date of Patent: Aug. 12, 2008

(54) LIQUID FUEL COMPOSITION HAVING ALIPHATIC ORGANIC NON-HYDROCARBON COMPOUNDS, AN AROMATIC HYDROCARBON HAVING AN AROMATIC CONTENT OF LESS THAN 15% BY VOLUME, AN OXYGENATE, AND WATER

(76) Inventor: Greg Binions, 28 Mill Street, Aurora, Ontario (CA) L4G 2R9

( * ) Notice: Subject to any disclaimer, the term of this patent is extended or adjusted under 35 U.S.C. 154(b) by 419 days.

(21) Appl. No.: 10/310,031

(22) Filed: Dec. 5, 2002

(65) Prior Publication Data

US 2004/0107634 A1 Jun. 10, 2004

(51) Int. Cl.
*C10L 1/18* (2006.01)
*C10L 1/32* (2006.01)

(52) U.S. Cl. ..... 44/301; 44/302; 44/359; 44/360; 44/388; 44/401; 44/402; 44/438; 44/446

(58) Field of Classification Search ..... 44/300, 44/301, 302, 360, 436, 446–452, 359, 388, 44/401, 402, 438
See application file for complete search history.

(56) References Cited

U.S. PATENT DOCUMENTS

| | | | | | |
|---|---|---|---|---|---|
| 1,907,309 | A | * | 5/1933 | Van Schaack, Jr. | 44/451 |
| 4,207,077 | A | | 6/1980 | Bove et al. | |
| 4,266,947 | A | * | 5/1981 | Hartle et al. | 44/327 |
| 4,341,038 | A | * | 7/1982 | Bloch et al. | 47/1.4 |
| 4,378,973 | A | * | 4/1983 | Sweeney | 44/352 |
| 4,541,836 | A | * | 9/1985 | Derderian | 44/452 |
| 4,603,662 | A | | 8/1986 | Norton et al. | |
| 4,749,382 | A | * | 6/1988 | Collins et al. | 44/354 |
| 4,929,252 | A | * | 5/1990 | Brillhart | 44/308 |
| 5,256,167 | A | | 10/1993 | Kaneko et al. | |
| 5,324,865 | A | * | 6/1994 | Beech et al. | 568/695 |
| 5,682,842 | A | * | 11/1997 | Coleman et al. | 123/25 C |
| 5,688,295 | A | | 11/1997 | Yang | |
| 5,693,106 | A | * | 12/1997 | Peter-Hoblyn et al. | 44/301 |
| 5,826,369 | A | * | 10/1998 | Jordan | 44/308 |
| 6,017,371 | A | * | 1/2000 | Gheysens et al. | 44/448 |
| 6,039,772 | A | * | 3/2000 | Orr | 44/359 |
| 6,302,929 | B1 | * | 10/2001 | Gunnerman | 44/302 |
| 6,458,173 | B1 | * | 10/2002 | Lin | 44/389 |
| 6,533,829 | B1 | * | 3/2003 | Bertha et al. | 44/302 |
| 6,652,608 | B1 | * | 11/2003 | Orr | 44/360 |
| 6,835,217 | B1 | * | 12/2004 | DeRosa et al. | 44/418 |
| 2003/0207783 | A1 | * | 11/2003 | Vandermeiren | 510/407 |
| 2004/0093789 | A1 | * | 5/2004 | Hart et al. | 44/301 |

FOREIGN PATENT DOCUMENTS

| | | | | |
|---|---|---|---|---|
| CA | 2342824 | A1 | * | 6/2001 |
| DE | 30 16 481 A 1 | | | 11/1981 |
| DE | 3033220 | A | * | 4/1982 |
| EP | 121089 | A2 | * | 10/1984 |
| FR | 2506299 | A | * | 11/1982 |
| GB | 487772 | | | 6/1938 |
| JP | 07278576 | A | * | 10/1995 |
| WO | WO 87/01384 | | | 3/1987 |

OTHER PUBLICATIONS

Speight, James G.; Chemical and Process Design Handbook, McGraw-Hill, 2002 (pp. 2.339-2.343).*
Radchenko et al. Methyl tert-Butyl Ether as a Component of Automotive Gasolines. Petroleum and Gas Processing. Chemistry and Technology of Fuels and Oils, May 1976, vol. 12 No. 5, pp. 336-339.*
Translation for DE 30 33 220 A1.*

* cited by examiner

*Primary Examiner*—Cephia D Toomer
(74) *Attorney, Agent, or Firm*—Browdy and Neimark

(57) ABSTRACT

The invention relates to a liquid fuel composition of: 10-80 vol % of a first component which includes at least two aliphatic organic non-hydrocarbon compounds; 20-65 vol % of a second component including at least one hydrocarbon and having an aromatic content of less than 15 vol % of the total of the second component; 1-35 vol % of a third component, which includes an oxygenate; and 0.01 to 20 vol % water, wherein at least one compound in the fuel composition is miscible with both water and hydrocarbons to provide a single phase composition. Such fuels have been found to reduce undesirable emissions in the exhaust gases and enable the use of recycled compounds and water in the fuel.

4 Claims, No Drawings

LIQUID FUEL COMPOSITION HAVING ALIPHATIC ORGANIC NON-HYDROCARBON COMPOUNDS, AN AROMATIC HYDROCARBON HAVING AN AROMATIC CONTENT OF LESS THAN 15% BY VOLUME, AN OXYGENATE, AND WATER

BACKGROUND OF THE INVENTION

The present invention relates generally to liquid fuel compositions such as those which may be used in internal combustion engines Environmental pollution from exhaust gases from engines, such as those used in automobiles, is a widespread problem. Various liquid fuel compositions have been tried in an effort to reduce such pollution. For example, it has been tried to form fuels from mixtures of naphtha or gasoline with methanol or other alcohols. Such fuels can greatly reduce the concentration of carbon monoxide (CO) and hydrocarbons in the exhaust gases. They can also replace conventional gasoline fuel.

When selecting a fuel composition, a number of factors must be considered. The fuel must be readily converted into energy by the engine. In an internal combustion engine, this means the fuel must have some volatility and must not be too viscous. The fuel must have good performance, that is, it must combust readily to give good acceleration to a vehicle. Preferably it should be stable, so that it does not separate on standing and does not chemically react with engine components during storage. It should be non-corrosive so that it does not damage the engine supply lines or storage vessels. The combustion products which will appear in the exhaust gases should be as low as possible in substances which are toxic or harmful to health or environment.

Although conventional gasoline does meet some of the above objectives, it is not a renewable resource. Thus it would also be desirable to find a fuel composition which was derived at least partly, from a renewable resource.

Although prior art fuels, which contain naphtha or gasoline mixed with methanol, ethanol or other alcohols do have a small effect in reducing the concentrations of carbon monoxide (CO) and hydrocarbons in the exhaust gases from automobiles, they have other problems. Since they contain unstabilized alcohols and ethers, they can cause problems such as swollen rubber gaskets, decomposition of rubber, engine parts corrosion and wear, reduced performance affecting fuel consumption and driveability index, oxidation stability and increased NOx values to name a few. Such fuels are also known to break down and degenerate during storage or at high temperature and may cause a build-up of gum residue on engine parts. In addition, these fuels are usually unable to operate once water is added to them, as the water does not properly dissolve in the fuel and tends to separate back out of the mixture after only a short time which in turn causes engine stalling and poor performance.

The present invention seeks to provide an emission reducing liquid fuel, which avoids or reduces some of the above problems and is therefore better for the environment. The present invention seeks to provide an improved emission reducing liquid fuel capable of efficiency and an output similar to or better than that of conventional gasoline, without any need to modify existing internal combustion gasoline engines. The invention also seeks to reduce the concentrations of carbon monoxide (CO), carbon dioxide (CO2), sulphur dioxide (SO2), nitrogen oxides (NOx), particulate matter (PM), volatile organic compounds (VOC) and total hydrocarbons (THC) in exhaust gases as compared to conventional gasoline.

SUMMARY OF THE INVENTION

It has now been found that fuel compositions which contain at least some water can outperform other fuel compositions, at least in some respects. The fuel composition of the invention not only can include water without separation of the components but can also improve the power of the fuel. Further, NOx and other emissions can be reduced, the composition can have improved oxidation stability and can reduce, by way of pH balancing, corrosion and wear. It further enables a way of using, in a new way, biomass products which might not otherwise be useful.

According to one aspect of the present invention there is provided a liquid fuel composition comprising: 10-80 vol % of a first component comprising at least two aliphatic organic non-hydrocarbon compounds; 20-65 vol % of a second component comprising at least one hydrocarbon and having an aromatic content of less than 15 vol % of the total of the second component; 1-35 vol % of a third component, which comprises an oxygenate; 0.01 to 20 vol % water, wherein at least one compound in the fuel composition is miscible with both water and hydrocarbons to provide a single phase composition.

DETAILED DESCRIPTION OF THE PREFERRED EMBODIMENTS

The first component comprises at least two aliphatic non-hydrocarbon organic compounds. Preferably these are volatile compounds. Suitable compounds include aliphatic monohydric alcohols, ketones, aldehydes and esters (such as acetates) preferably having up to about 13 carbon atoms. Compounds which form undersirable combustion products (for example, aldehydes which may form formaldehyde) are less preferred. In a conventional combustion engine, performance may be a combination of performances in a range. Thus, for example, a compound of lower boiling point may make a certain contribution to the overall performance of the fuel, but may leave another aspect of the performance lacking. The lacking aspect may be compensated or fulfilled by a compound of a different, perhaps higher, boiling point. Thus it is preferred to have several compounds in this component in the composition to represent a full range of values.

The compositions can contain from 10 to 80 vol %, preferably from 30 to 50 vol %, more preferably from 35 to 45 vol % of the first component. However, the quantity used will depend on many factors including the nature of the other ingredients, availability and cost.

Although in some cases as little as 10 vol % of the first component may be used, more preferably the fuel composition has at least 35 vol % of the first component.

Compounds suitable for the first component may be derived from any source, such as petroleum, natural gas, coal or bio feedstock. One suitable source of compounds for the first component is recycled solvents.

Use of the first component can thus reduce corrosion and undesirable products such as CO, CO2, HxCy, SOx, NOx, THC, VOC, aromatics etc. contained in the exhaust gases of automobiles.

It is preferable that at least one compound of the first component is an aliphatic monohydric alcohol which is a non-straight chain alcohol.

The use of a non-straight chain or branched aliphatic alcohol can contribute to obtaining a higher octane value and also can facilitate blending of the components without separation.

Preferred compounds for use in the first component include ethyl alcohol, propyl alcohol, butyl alcohol, octyl alcohol, butanone, methyl isobutyl ketone and ethyl acetate.

Preferred branched aliphatic alcohols include isopropyl alcohol (IPA) and isobutyl alcohol (IBA).

Although many different compounds may be used as compounds for the first component, some, such as methyl alcohol (which tends to be quite corrosive) are less preferred or are preferably avoided or only used in lesser quantities.

The compositions need at least one compound which is mutually miscible with both water and hydrocarbons to ensure that, after blending, the components combine as a single phase. Compounds suitable for use as the first component, for example alcohols, especially higher alcohols such as decanol, will often provide such mutual miscibility and can thus function as mutually miscible compounds.

The second component is the hydrocarbon component. It is preferred that this component is low in aromatic content, (i.e., compounds such as benzene, toluene and xylene) at least less than 15 vol %, preferably less than 10 vol %. Aromatic hydrocarbons tend to be imperfectly combusted. Thus, by reducing the aromatic content the COx and hydrocarbon content in the exhaust can be reduced, as well as reducing the exhaust aromatic content. Further, it is believed that the aromatic content contributes to negative properties of a fuel composition, such as the corrosiveness, and thus a lower aromatic content is preferred.

The hydrocarbons may be saturated or unsaturated and may be derived from any source such as petroleum, natural gas, coal or bio-feedstock. Thus they may be mixtures of various hydrocarbons. the hydrocarbons are preferably straight chain. Light naphthas are suitable. Some types of gasoline would also be suitable.

The compositions can contain from 20 to 65 vol %, preferably from 40 to 55 vol %, more preferably from 45 to 50 vol %, of the hydrocarbon component.

The specifications of an example of a suitable light naphtha for the second component are shown below:

| ITEM DESCRIPTION | IDEAL | RANGE | TEST METHOD |
|---|---|---|---|
| Specific Gravity (Density) (kg/m3) | .70 | 65 to .74 | ASTM D4052 |
| Reid Vapor Pressure (RVP psi) | 8 to 11 psi | 5 to 13 | ASTM D5191 |
| Octane RON | 78 | 68 to 82 | ASTM D2699 |
| Initial Boiling Point | 40 C. IBP | 30 C. to 65 C. | ASTM D86 |
| Final Boiling Point | 175 C. FBP | 130 C. to 240 C. | ASTM D86 |
| Sulphur (% wt) | 001 | Under .04 | GC/SCD |
| Sulphur (ppm) | under 50 | Under 400 ppm | |
| Aromatics | 7 | 2 to 15 | |
| Paraffins (Vol %) | under 50 | 40 to 85 | ASTM D5443 |
| Naphthenes (Vol %) | 30 to 40 | 10 to 60 | |

Further, straight-chain saturated or unsaturated hydrocarbons whose number of carbon atoms is 9 or less may be used in place of all or a part of the low aromatic naphtha for the second component.

The third component comprises at least one oxygenate. Oxygenates are usually compounds which contain oxygen and which can provide a source of oxygen during combustion to assist in the complete combustion of the carbon content of the other compounds in the fuel composition and can reduce the content of carbon monoxide in the exhaust.

The compositions can contain from 1 to 35% of the third component, preferably from 5 to 20 vol %, more preferably from 8 to 15 vol %.

Suitable compounds are compounds such as ethers which generally have at least two hydrocarbon groups which each have seven, preferably six, or less carbon atoms in the hydrocarbon chain. Preferred ethers include methylcyclopentadienyl manganese tricarbonyl (MMT), methyl tertiary butyl ether (MTBE), tertiary amyl methyl ether (TAME) ethyl tertiary-butyl ether (ETBE) and dibutyl ether or a similar component. Iso octane is also sometimes used as an oxygenate.

In this way, the octane value of the resulting fuel can be improved by a small blended amount without compromising the integrity of the fuel, so the price of the fuel can be kept low level and lubricity can be maintained.

The compositions contain at least some water, in particular from 0.01 vol % to 20 vol %. It has been found not only that it is possible to use water in such fuel compositions, but also that the water can contribute to the beneficial properties of the compositions such as by reducing NOx, CO or particulate content in the exhaust. Preferably the compositions contain at least 0.05 vol %, more preferably at least 0.75 vol % and particularly at least 1 vol %. It has also been found that the water may contain various dissolved or suspended substances without disabling the fuel and sometimes even enhancing the effects of the fuel.

Although in some cases there may be as much as 20 vol % of water in the compositions, it is preferred that there is less than 10 vol % and more preferably, less than 5 vol % of water.

The water may be derived from most sources. For example the water may be tap water, distilled water, spring or mineral water or distilled sea water. Also the water may include compounds derived from biomass or biological materials such as grass clippings, leaves, fruits and plants. Of course, some compounds, such as sugars, would be detrimental to the compositions and should be avoided. With regard to sugars, it is still possible to use aqueous solutions derived from sugar-containing material, such as fruit juice, provided the sugars are removed, such as by fermentation. Although some trials may be needed to determine limits and suitability of such additional materials, an advantage of the fuel compositions is that they do permit the use of such renewable biological materials. Thus the water may contain various water soluble compounds such as chlorophylls, lipids, proteins, phytols, carotenes, quercetin, acids (such as citric acid) and alkaline compounds. The water may also contain urea, thus if salt and mineral content is appropriately reduced or removed, urine may be used as water component.

Compounds derived from biomass may be obtained, for example, by grinding into small pieces or mulching products such as grass clippings, leaves or fruits. Water is added together with compounds which may accelerate the breakdown of the products and the extraction of soluble compounds. the resulting mixture is pressed and filtered to obtain an aqueous solution of compounds derived from biomass.

A variety of compounds may be present as additives in fuel compositions according to the invention. Thus it is frequently desirable, and sometimes necessary to adjust the properties by providing one or more additives. Types of additive which may be used include: compounds which improve the miscibility of the water in the composition (water bonding agents) or help stabilize the compositions against oxidation; compounds which help adjust the pH of the compositions (pH balancing agents) preferably to bring the composition to a non-corrosive neutral pH value; compounds which reduce corrosiveness or provide lubricity (lubricants) by inhibiting reaction with or adherence to engine or storage components; compounds which help stabilize the compositions for long term storage (stabilizing agents) by reducing gum or residue build-up in carburettors and other engine parts or storage components or by prolonging the storage life of the fuel; and compounds which reduce the flash point of the compositions and thus improve their safety. Compounds useful as additives which function in one or more of the above capacities include: decanol, dodecanol, tetradecanol, octyl alcohol, cyclohexane, pentane, methyl cyclohexane or similar material and micro lubricating synthetic and petroleum distillates. Petroleum distillates, also called synthetic (lubricating) distillates and petroleum lubricating distillates, provide a readily available source of compounds which can function in a lubricant or corrosion reducing capacity for example, Octel Starreon markets a mixture of suitable synthetic lubricant distillates under the Trade name DC 11.

It is preferred that the volume percentage of the first component is 40% or more than that of the second component. In particular, it is preferred that the volume percentage of the first component is 50% or more that of the second component.

There may be overlap between the components. That is, for example, compounds such as (lower) alcohols or esters which are suitable as the aliphatic non-hydrocarbon compounds of the first component may serve as an oxygenate which is the third component. Water also may sometimes serve as at least a part of the oxygenate component.

Further, a non-straight chain monohydric (primary) alcohol, ketone or acetate is preferably employed as at least one compound of the first component because the polarity may be lower than that of a straight-chain alcohol and thus blending with hydrocarbon components, ethers and esters may be improved.

Further, with regard to volatility and cost it is preferable to use, as the ether, an ether having two chain hydrocarbon groups whose number of carbon atoms is 6 or less.

Since there is a range of suitable compounds for the components, the choice of particular compounds may be based on cost or availability.

Bearing in mind that compounds containing nitrogen or sulphur as heteroatoms will tend to contribute to the concentration of NOx and SOx in the exhaust gases, it is preferred to use less of such compounds, or avoid using them.

To prepare the compositions, the various components, and any desired additives, are mixed together followed by stirring, agitation or any other mechanical motion needed to blend the composition into a single phase. It is important that the compositions are stable and remain in a single phase. If any phase separation occurs it may render the composition unsuitable as a fuel. The order of mixing is generally not critical, however it will be understood that it is preferable to first mix components of similar polarity or which are mutually soluble. On the one hand, any ethers, esters, ketones and alcohols may be sequentially added to the hydrocarbon component such as low aromatic naphtha which has low polarity. On the other hand, any ethers, esters, ketones and the low aromatic naphtha may be sequentially added to any alcohol. Also the water component is preferably added first to an alcohol component. Also it is preferred to first prepare a test mix and establish the pH value of the solution, so that if any pH adjusting agent is needed to neutralize the pH, the quantity needed can be established. If the mixture is too acid it may be desirable to add an appropriate amount of an alkaline pH adjusting agent and if the mixture is too alkaline it may be desirable to add an appropriate amount of an acidic pH adjusting agent.

As a first step in formulation, it is preferred to do a sample mix of the aliphatic monohydric alcohols, saturated and unsaturated hydrocarbons and ether or ester to determine the pH value. This may vary from acidic to alkaline. With this determined, one can then adjust the water and other ingredients to appropriate levels to ensure that the final formulation has approximately a neutral pH. Use of watery fluids derived from plant based material can provide added energy value and varies from alkaline to acidic.

The respective blended primary fuels can thus be effectively mixed without being separated from each other.

Unless otherwise stated, the following are examples of blends which have been prepared according to the invention and which include water.

EXAMPLE 1

This example was prepared by blending together 20 vol % of isobutanol (IBA) as one compound of the first component, 15 vol % of isopropanol (IPA) as another compound of the first component, 15 vol % of methyl tertiary butyl ether (MTBE) as the third component, 47 vol % of low aromatic naphtha as the second component and 3 vol % tap water.

EXAMPLE 2

This example was prepared by blending 21 vol % of n-butanol as one compound of the first component, 13 vol % of n-propanol (NPA) as another compound of the first component, 10 vol % of methylcyclopentadienyl manganese tricarbonyl (MMT) as the third component, 5 vol % ethanol as another compound of the first component, 45 vol % of low aromatic naphtha as the second component, 2.5 vol % distilled water and 0.5 vol % of a combination of octyl alcohol, cyclohexane and petroleum distillates.

EXAMPLE 3

This example was prepared by blending 17 vol % of isobutanol (IBA), 4 vol % butanone, 13 vol % of isopropanol (IPA), 15 vol % of dibutyl ether, 45 vol % of low aromatic naphtha, 4.6 vol % water containing compounds derived from biological material, 1 vol % de-sugared fruit juice and 0.4 vol % of a combination of decanol and synthetic lubricating distillates.

EXAMPLE 4

This example was prepared by blending 18 vol % of isobutanol, 14 vol % of isopropanol (IPA), 20 vol % of ethanol, 45 vol % of low aromatic naphtha, 2.8 vol % distilled seawater and 0.2 vol % of a combination of dodecanol and synthetic distillate.

EXAMPLE 5

This example was prepared by blending 18 vol % of isobutanol (IBA), 12 vol % of isopropanol (IPA), 17 vol % of tertiary amyl methyl ether (TAME) as mixed ethers, 46 vol % of low aromatic naphtha, 6.7 vol % spring water and 0.3 vol % of a combination of pentane and petroleum lubricating distillate.

EXAMPLE 6

This example was prepared by blending 22 vol % of n-butanol, 10 vol % of n-propanol (NPA), 3 vol % isopropanol, 15 vol % of methylcyclopentadienyl manganese tricarbonyl (MMT), 48 vol % of low aromatic naphtha, 1.9 vol % water containing citric acid and 0.1 vol % synthetic lubricating distillate.

EXAMPLE 7

This example was prepared by blending 15 vol % of ethanol, 15% vol % isobutanol, 15 vol % of isopropanol (IPA), 40 vol % of low aromatic naphtha, 13.5 vol % of water containing compounds derived from biological material and 1.5 vol % of a combination of methyl cyclohexane, octyl alcohol and petroleum distillate mix.

EXAMPLE 8

This example was prepared by blending 25 vol % of ethanol, 5 vol % of n-butanol (NBA), 5 vol % of isobutanol, 3 vol % isopropanol, 3 vol % n-propanol, 3 vol % butanone, 3 vol % methyl isobutyl ketone, 3 vol % ethyl acetate, 2 vol % MTBE, 2 vol % iso octane, 2 vol % MMT, 43 vol % of low aromatic naphtha, 0.9 vol % water and 0.1 vol % synthetic distillate.

EXAMPLE 9

This example was prepared by blending 20 vol % isobutanol, 13 vol % isopropanol, 15 vol % iso octane, 48 vol % of low aromatic naphtha, 3.999 vol % and 0.001 of a combination of synthetic and petroleum distillate.

EXAMPLE 10

This example was prepared by blending 30 vol % ethanol, 15 vol % isobutanol, 2 vol % octyl alcohol, 3 vol % iso octane, 40 vol % of low aromatic naphtha, 9.95 vol % water and 0.05 vol % synthetic distillate.

COMPARATIVE EXAMPLE

This example is a conventional alcohol fuel and is included for purposes of comparison with the fuel composition of the invention. This example was prepared by blending 43 vol % of methyl alcohol, 5 vol % of isobutyl alcohol (IBA), 4 vol % of methyl tertiary butyl ether (MTBE) and 48 vol % of light duty naphtha.

The following tables 1 and 2 show the results of exhaust emission tests conducted on sample blends, the comparative example (Table 2) and conventional gasoline. The reduction in emissions is shown as being significant as proven on various makes and years of cars in the Ontario Drive Clean Emissions Tests (a government mandated emissions test) and Environment Canada Emissions Tests. Environment Canada tests were conducted on a 1989 Crown Victoria and a 1990 Plymouth Acclaim for both highway and city driving test cycles.

In the following tables: ODC stands for Ontario Drive Clean which is an emissions test procedure of the Ontario provincial government of Canada; ECET stands for Environment Canada Emissions Test which is an emissions test procedure of the Environment Department of the Federal Government of Canada; where a number of a blend is referred to, such as "Blend 1", it is intended to refer to a blend of the same number as defined above in the Examples 1 to 10; "City" means the test was intended to reflect city driving conditions and "Hiway" means the test was intended to reflect highway driving conditions; "gas" or "gasoline" means that the composition tested was a conventional gasoline used for comparative purposes since a fuel was sometimes used in engines of different make, the results in the table are sometimes different for the same blend of fuel, but the comparison with regular gasoline shown in the table, illustrates the improvements achievable by compositions of the invention.

TABLE 1

Comparison of Amounts of Generated Exhaust Gases

| | CO % Value | HC Value | NOx Value |
|---|---|---|---|
| Example A ODC Blend 1 | .01 | 9 ppm | 922 ppm |
| Gasoline ODC | .02 | 6 ppm | 1777 ppm |
| Example B ODC Blend 1 | .04 | 1 ppm | 3 ppm |
| Gasoline ODC | .13 | 3 ppm | 9 ppm |
| Example C ODC Blend 3 | .02 | 0 ppm | 3 ppm |
| Gasoline ODC | .13 | 3 ppm | 9 ppm |
| Example D ODC Blend 4 | .25 | 97 ppm | 220 ppm |
| Gasoline ODC | .48 | 157 ppm | 518 ppm |
| Example E ODC Blend 8 | 0.0 | 47 ppm | 2053 ppm |
| Gasoline ODC | .51 | 133 ppm | 3071 ppm |
| Example F ODC Blend 9 | 0.0 | 82 ppm | 2005 ppm |
| Gasoline ODC | .55 | 113 ppm | 2900 ppm |
| Blend 1 Fuel Used - City | 10.47 1/100 km | | CO2 415.67 g/mile |
| Gas Used -City | 11.89 1/100 km | | CO2 444.00 g/mile |
| Blend 4 Fuel Used - City | 22.9 km/2 liters | | CO2 11.7% |
| Gas Used - City | 19.1 km/2 liters | | CO2 14.0% |
| Blend 8 Fuel Used - City | 22.7 km/2 liters | | CO2 12.5% |
| Gas Used - City | 19.1 km/2 liters | | CO2 14.0% |
| Blend 1 Fuel Used - Highway | 6.68 1/100 km | | CO2 252.33 g/mile |
| Gas Used - Highway | 7.14 1/100 km | | CO2 267.33 g/mile |

TABLE 2

Comparison of Amounts of Generated Exhaust Gases

| | CO % Value | HC Value | NOx Value |
|---|---|---|---|
| Blend Example 2 ODC | .04 | 1 ppm | 3 ppm |
| Blend Example 3 ODC | .02 | 0 ppm | 3 ppm |
| Comparative Example | .11 | 2.1 ppm | 7 ppm |
| Gasoline ODC | .13 | 3 ppm | 9 ppm |

While the present invention has been described with reference to the above embodiment, the present invention is by no means limited thereto and it goes without saying that various modifications and additions can be made within the range, which does not depart from the gist of the invention. That is, other primary fuels and additives may be arbitrarily added within the ranges in which the characteristics of the fuels for internal combustion engines of the present invention are not greatly modified and such fuels are also included in the scope of the present invention.

The invention claimed is:

1. A liquid fuel composition comprising:

10-80 vol % of a first component comprising at least two aliphatic organic non-hydrocarbon compounds selected from the group consisting of propanol, butanol, ethanol, butanone, methyl isobutyl ketone, octyl alcohol, and ethyl acetate;

20-65 vol % of a second component which is a light naphtha;

1-35 vol % of a third component selected from the group consisting of methylcyclopentadienyl manganese tricarbonyl (MMT), methyl tertiary butyl ether (MTBE) tertiary amyl methyl ether (TAME) and ethyl tertiary-butyl ether (ETBE) and dibutyl ether;

0.75 to 20 vol % water, wherein at least one compound in the fuel composition is miscible with both water and hydrocarbons to provide a single phase composition wherein said liquid fuel composition reduces CO and $NO_x$ emissions in exhaust gases of internal combustion engines while producing fuel power greater than that of gasoline; and wherein the volume percentage of the first component is 40% or more than that of the second component.

2. A liquid fuel composition comprising:

10-80 vol % of a first component comprising at least two aliphatic organic non-hydrocarbon compounds selected from the group consisting of propanol, butanol, ethanol, butanone, methyl isobutyl ketone, octyl alcohol, and ethyl acetate;

20-65 vol % of a second component which is a light naphtha;

1-35 vol % of a third component selected from the group consisting of methylcyclopentadienyl manganese tricarbonyl (MMT), methyl tertiary butyl ether (MTBE), tertiary amyl methyl ether (TAME) and ethyl tertiary-butyl ether (ETBE) and dibutyl ether;

0.75 to 20 vol % water, wherein at least one compound in the fuel composition is miscible with both water and hydrocarbons to provide a single phase composition wherein said liquid fuel composition reduces CO and $NO_x$ emissions in exhaust gases of internal combustion engines while producing fuel power greater than that of gasoline;

wherein the volume percentage of the first component is 40% or more than that of the second compound; and wherein the composition further comprises from 0.001 to 3 vol % of an additive selected from the group consisting of decanol, dodecanol, tetradecanol, octyl alcohol, cyclohexane, pentane and methyl cyclohexane.

3. A liquid fuel composition comprising:

10-80 vol % of a first component comprising at least two aliphatic organic non-hydrocarbon compounds selected from the group consisting of propanol, butanol, ethanol, butanone, methyl isobutyl ketone, octyl alcohol, and ethyl acetate;

20-65 vol % of a second component which is a light naphtha;

1-35 vol % of a third component selected from the group consisting of methylcyclopentadienyl manganese tricarbonyl (MMT), methyl tertiary butyl ether (MTBE), tertiary amyl methyl ether (TAME) and ethyl tertiary-butyl ether (ETBE) and dibutyl ether;

0.75 to 20 vol % water, wherein the water contains at least one compound selected from the group consisting of acids, alkalis, lipids and proteins; and wherein the volume percentage of the first component is 40% or more than that of the second component;

wherein at least one compound in the fuel composition is miscible with both water and hydrocarbons to provide a single phase composition wherein said liquid fuel composition reduces CO and $NO_x$ emissions in exhaust gases of internal combustion engines while producing fuel power greater than that of gasoline.

4. A liquid fuel composition comprising:

10-80 vol % of a first component comprising at least two aliphatic organic non-hydrocarbon compounds selected from the group consisting of ethanol, propanol and butanol;

20-65 vol % of a second component which is a light naphtha;

1-35 vol % of a third component, which comprises an oxygenate selected from the group consisting of methylcyclopentadienyl manganese tricarbonyl (MMT), methyl tertiary butyl ether (MTBE), tertiary amyl methyl ether (TAME) and ethyl tertiary butyl ether (ETBE) and dibutyl ether;

0.75 to 20 vol % water, wherein the water contains at least one compound selected from the group consisting of acids, alkalis, lipids and proteins;

wherein the volume percentage of the first component is 40% or more than that of the second component; and wherein at least one compound in the fuel composition is miscible with both water and hydrocarbons to provide a single phase composition wherein said liquid fuel composition reduces CO and $NO_x$ emissions in exhaust gases of internal combustion engines while producing fuel power greater than that of gasoline.

* * * * *